US005542570A

United States Patent [19]

Nottingham et al.

[11] Patent Number: 5,542,570

[45] Date of Patent: Aug. 6, 1996

[54] TOY DISPENSER WITH FEED MEANS

[75] Inventors: John R. Nottingham, Hunting Valley; John W. Spirk, Jr., Gates Mills; Patrick W. Brown, Strongsville; Jerzy Perkitny, Bay Village, all of Ohio

[73] Assignee: Cap Toys, Inc., Bedford Heights, Ohio

[21] Appl. No.: 388,154

[22] Filed: Feb. 13, 1995

[51] Int. Cl.[6] ..... B65H 3/00

[52] U.S. Cl. ..... 221/192; 221/254; 221/277

[58] Field of Search ..... 221/254, 277, 221/192, 258, 75, 24, 124, 237, 317, 155; 187/267, 268

[56] References Cited

U.S. PATENT DOCUMENTS

| | | | |
|---|---|---|---|
| 190,268 | 5/1877 | Bicknell | 221/254 |
| 481,280 | 8/1892 | Kibby | 221/254 |
| 973,297 | 10/1910 | Poeppel | 221/254 |
| 1,026,650 | 5/1912 | Bloom | 187/267 |
| 2,074,674 | 3/1937 | Sadjian | 221/254 |
| 2,479,860 | 8/1949 | Otis | 221/277 |
| 2,496,304 | 2/1950 | Muffly | 221/258 |
| 3,175,055 | 2/1973 | Kendrick et al. | 221/75 |
| 3,319,825 | 5/1967 | Dore | 221/277 |
| 3,572,549 | 3/1971 | Willsey et al. | 221/226 |
| 3,682,353 | 8/1972 | Roast | 221/277 |
| 4,469,242 | 9/1984 | Costa | 221/4 |
| 4,560,086 | 12/1985 | Stol | 221/24 |
| 4,902,263 | 2/1990 | Ito et al. | 453/49 |
| 4,948,012 | 8/1990 | Snediker, Sr. et al. | 221/195 |
| 5,176,288 | 1/1993 | Craven | 221/124 |
| 5,307,941 | 5/1994 | Siegel | 211/11 |
| 5,318,200 | 6/1994 | Allen et al. | 221/192 |

FOREIGN PATENT DOCUMENTS

| | | | |
|---|---|---|---|
| 2207396 | 8/1973 | Germany | 221/254 |

*Primary Examiner*—Kenneth Noland
*Attorney, Agent, or Firm*—William Squire

[57] ABSTRACT

A transparent thermoplastic housing has an upper and a lower compartment divided by a ramp. The lower compartment houses a battery, motor and drive mechanism for turning a candy dispensing screw in communication with the upper compartment. The lower compartment is hidden by an outer opaque label. Candy pieces of like dimensions are stored in the upper compartment and fed serially to the screw by a first channel formed with the ramp. A second channel next to the screw along its length maintains the candy received from the first channel aligned serially. The screw displaces the candy from the first channel to the second channel and to a dispensing port at the top of the housing. A clutch in the drive mechanism permits the screw to be turned manually.

28 Claims, 4 Drawing Sheets

TOY DISPENSER WITH FEED MEANS

This invention relates to dispensers and, more particularly, to toy candy dispensers with dispensing mechanisms.

A toy dispenser according to the present invention comprises a housing having a compartment for storing pieces; a piece dispensing port; means arranged to isolate the pieces in the compartment from the port and manually and electrically operated displacement means for selectively displacing pieces from the compartment to the port.

In one embodiment the displacement means includes channel means for displacing the pieces from the compartment to the port one piece at a time.

In a further embodiment, the displacement means includes screw means for selectively displacing the pieces to the port.

In another embodiment, the displacement means includes clutch means for selectively manually and electrically operating the screw means.

In a still further embodiment, the displacement means includes a piece displacement screw and electrical operated drive means coupled to the screw for operating the screw.

In another embodiment, the displacement screw has a manual gripping means external the housing for manually rotating the screw, the drive means including motor means including a motor and a clutch coupling the screw to the motor such that the screw can be manually rotated independently of the motor.

In a further embodiment, the pieces are candy, the housing is substantially transparent and the screw is an opaque color visible through the housing.

A further embodiment includes means for displacing candy from the compartment to the port one piece at a time.

In a further embodiment the housing is dimensioned to be held in one hand and electrically operated by the one hand.

BRIEF DESCRIPTION OF THE DRAWING

In FIGS. 1—3, a manual/motorized hand held candy dispenser 2 comprises a preferably molded thermoplastic transparent housing 4 formed of two mating halves 6 and 8 fastened together by screws 10. The housing 4 has a candy discharge port 12. The housing 4 is dimensioned so that it can be held in one hand and grasped between the thumb and the remaining fingers of the one hand. The thumb is used to electrically activate the dispenser 2 as will be explained below. The housing 4 has two primary compartments 14 and 16 at respective upper and lower sections of the housing. The compartments are formed by mating respective compartment halves 14', 16' in housing half 6 and compartment halves 14", 16" in half 8, FIGS. 7 and 5, respectively.

Figure 12:
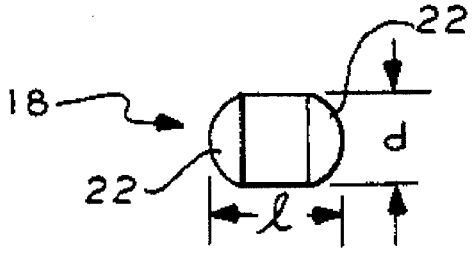
FIG. 12 is a side elevation view of a representative candy stored and dispensed by the dispenser of FIG. 1.

Compartment 14 stores a quantity of like dimensioned candy pieces 18, FIG. 12. The candy pieces in this embodiment are hard candy somewhat barrel shaped having a circular cylindrical central portion 20 and two like semi-spherical end portions 22. However, other candies, of other shapes and dimensions may be used in a dispenser in accordance with a given implementation. The candy pieces 18 central portion has a diameter d which is smaller than the length dimension 1.

Figure 1:
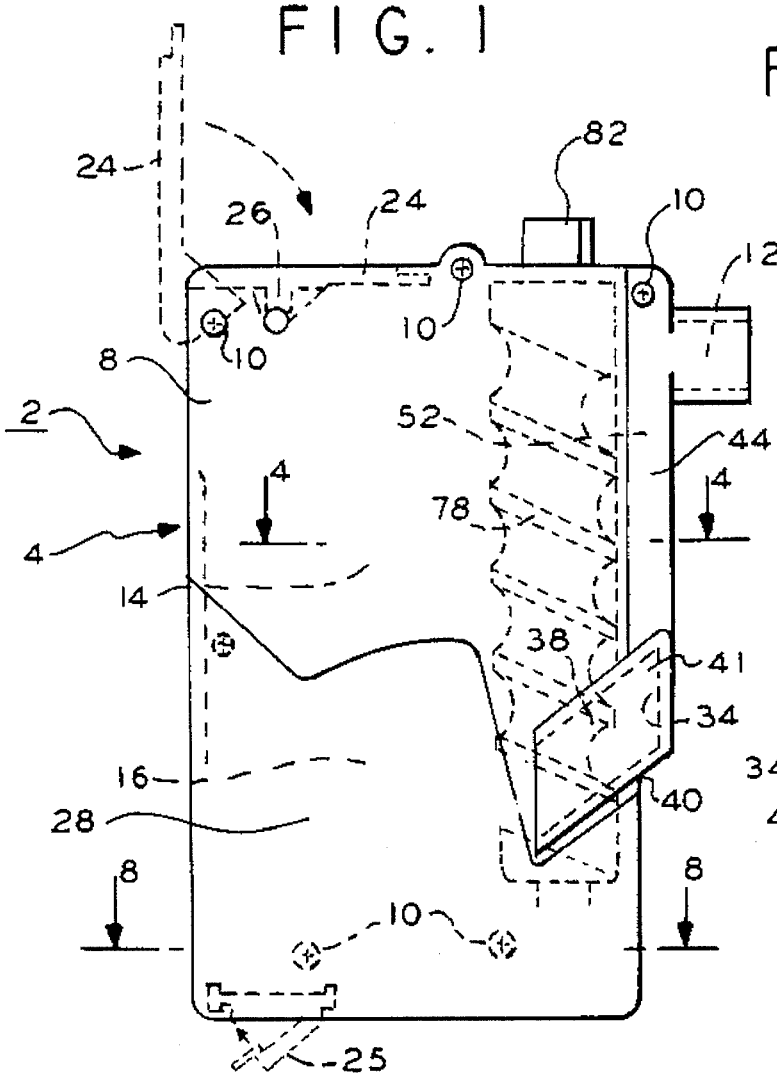
FIG. 1 is a side elevation view of a toy candy dispenser according to one embodiment of the present invention.
Figure 3:
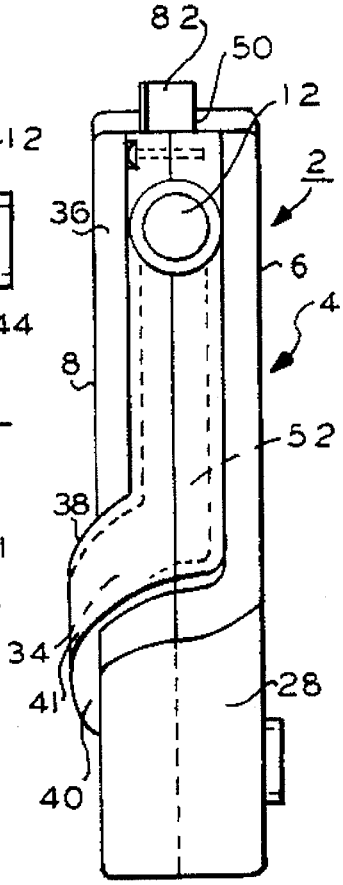
FIG. 3 is a front elevation view of the dispenser of FIG. 1.
Figure 2:
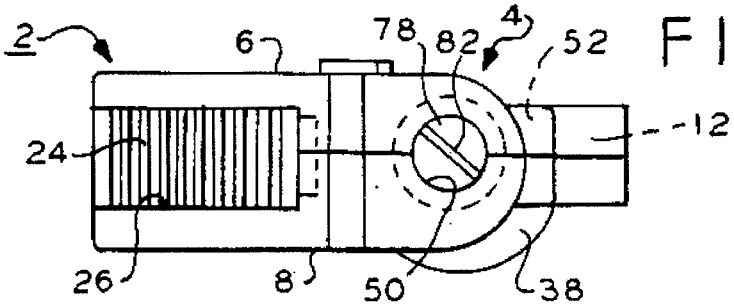
FIG. 2 is a plan view of the dispenser of FIG. 1.

In FIGS. 1 and 2, a cover 24 encloses a candy fill opening 26, shown in the open position in phantom, through which opening compartment 14 is filled with pieces 18.

An opaque label 28 circumscribes the lower compartment 16 so that substantially only upper compartment 14 is externally visible. The label 28 carries identifying indicia for the dispenser and its candy contents.

Figure 4:
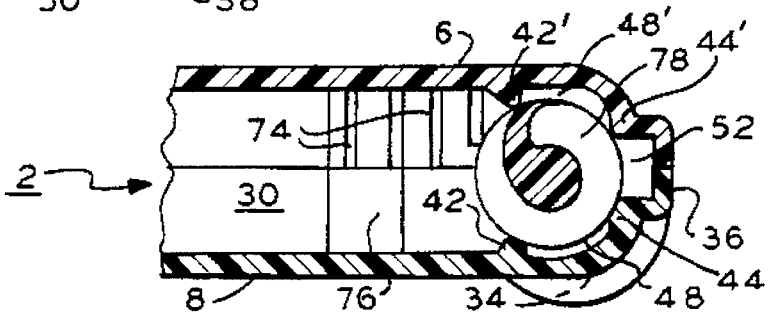
FIG. 4 is a fragmentary sectional view of the dispenser of FIG. 1 taken along lines 4—4.
Figure 5:
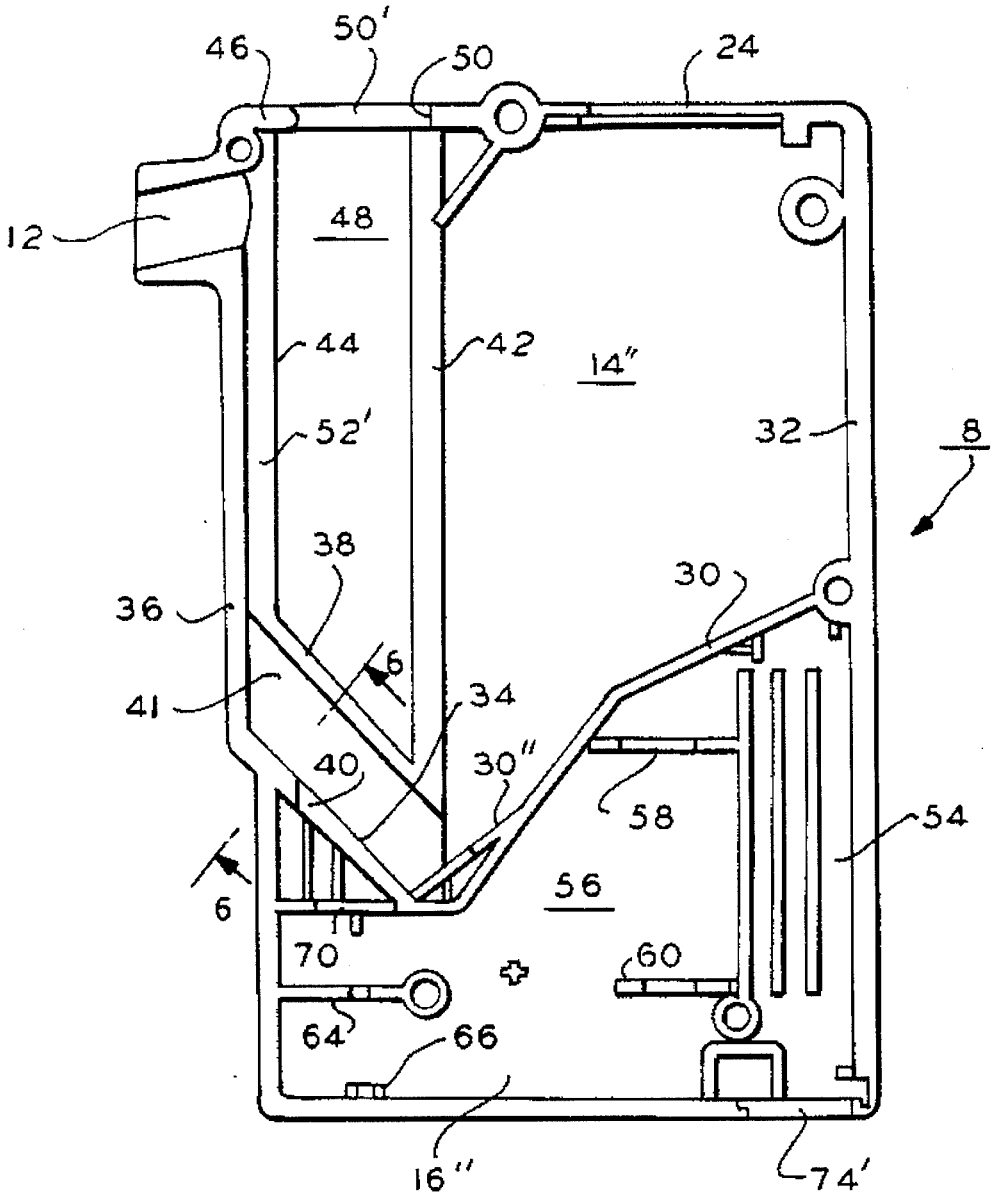
FIG. 5 is a side elevation view of one half of the housing of the dispenser of FIG. 1.
Figure 6:
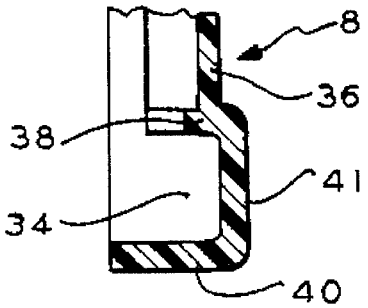
FIG. 6 is a sectional view of the housing half of FIG. 5 taken along lines 6—6.

In FIG. 5, compartment half 14" is formed by a ramp 30 which extends from side wall 32 to channel 34. Channel 34 extends from the base of the ramp 30 to opposite housing side wall 36. The channel 34, FIGS. 5 and 6, has two arcuate side walls 38 and 40 and a base wall 41 and is a segment of a helix. In FIGS. 4 and 5, a rib 42 and wall 44 extend parallel from top housing wall 46 to wall 38 forming a longitudinal channel 48 in communication with one half 50' of circular housing top opening 50 and channel 34. Walls 44 and 36, FIGS. 4 and 5, form one half 52' of channel 52.

Channel 52 is in communication with port 12. The channel 34 is in communication with the remainder of compartment 14" adjacent to ramp 30 at its base region between walls 38 and 40. The candy pieces 18 are dimensioned to fit between the walls 38 and 40 and rib 42 at the base of the ramp 30.

Compartment half 16" is divided into a battery compartment half 54 and a drive mechanism compartment 56. Supports 58, 60 support a motor 62, FIG. 7 and supports 64, 66 form bearings for drive shaft 68, FIG. 7. Support 70 supports clutch 72, FIG. 7. Similar battery compartment half, supports and bearings are in the other half 16' of compartment 16, FIG. 7.

Figure 7:
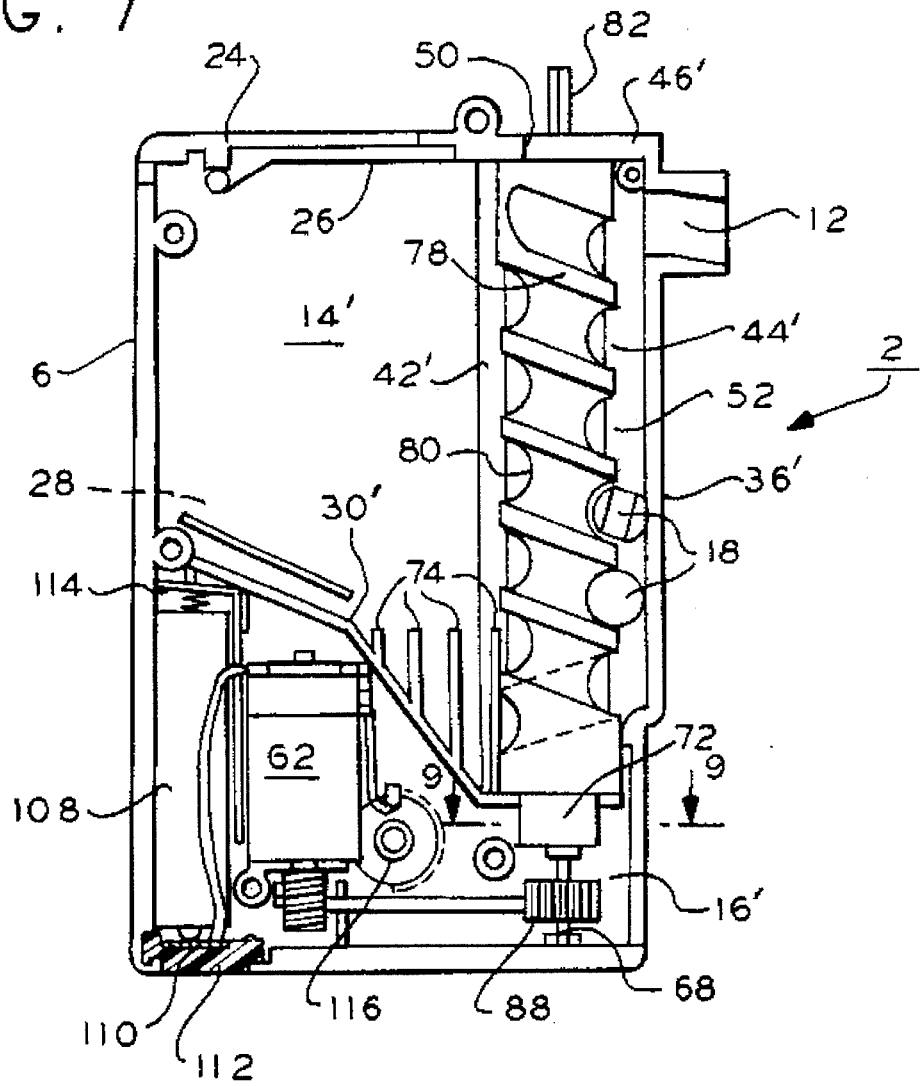
FIG. 7 is a side elevation view of the other half of the housing and a candy displacement mechanism including a candy displacement screw located within the housing.

In FIG. 7, compartment 14' includes a rib 42' which extends from top wall 46' to the base of ramp 30'. Ramp 30' mates with ramp 30 FIG. 5 to form a single ramp and compartments 14 and 16. Wall 44' with the side wall 36' of the housing forms the other half of channel 52. Ribs 42' and wall 44' form channel 48' diametrically opposite channel 48, FIG. 4.

An array of ribs 74 extend from ramp 30' and spaced apart to preclude candy pieces from contacting the ramp 30' in the array of ribs 74 region. As a result, the ramp 30, FIG. 4, is divided into a channel 76. The channel 76 is sufficiently wide so as to permit the candy pieces in the compartment 14 to be oriented in a serial array single file laying on ramp 30 in communication with the helical channel 34. However, this channel 76 and serial array is not essential for operation of the dispenser and the ribs 74 may be omitted.

Located in channels 48 and 48', FIG. 4, is a preferably molded thermoplastic screw 78 having a helical candy displacing groove 80. The groove 80 is dimensioned so as to receive the candy pieces 18 as oriented in FIG. 7. In FIG. 7 the candy pieces 18 long axes are substantially horizontal with respect to gravity. Only one piece 18 can fit in the groove 80 in a given axial position in the channel 52 as shown in FIG. 7. The screw 78 is in contact with the candy pieces in the compartment 14. This is important because as the screw rotates it lifts the pieces in the compartment at ramp 30" (and ramp 30' when ribs 74 are omitted) and precludes jams of pieces entering into the screw groove 80 at helical channel 34. The pieces 18 can only enter the channel 34 in screw groove 80 in single serial orientation. Thus the lifting of the stored pieces above the entrance to the channel 34 by the screw 78 in the compartment 14 mixes up the pieces to preclude jams.

The screw 78 has a flat knob 82 protruding above the housing 4 through opening 50 which can be manually gripped for manually turning the screw 78. The screw 78 is preferably opaque and colorful and is visible through the housing 4.

Figure 8:
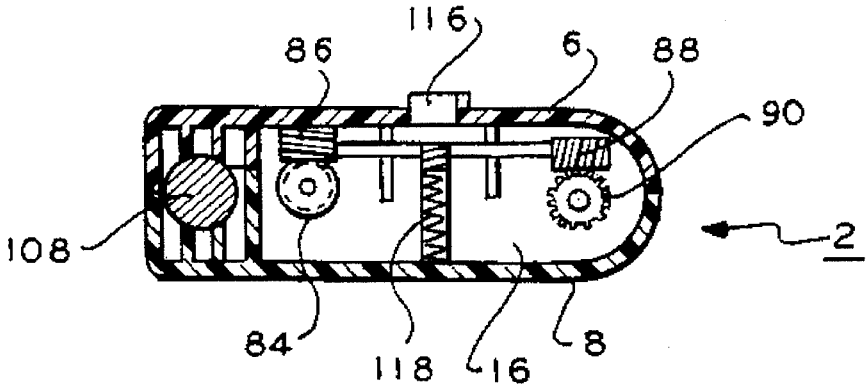
FIG. 8 is a plan sectional view of the embodiment of FIG. 1 taken along lines 8—8 showing the screw drive train portion of the candy displacement mechanism.

The drive mechanism for rotating the screw, FIGS. 7 and 8, includes motor 62, a worm gear 84 driven by the motor 62 and engaged with a spur gear 86. Spur gear 86 drives worm gear 88 which drives spur gear 90 attached to shaft 68. Clutch 72 is also fixed to shaft 68. Clutch 72 comprises a two way clutch mechanism, FIGS. 9, 10 and 11, for rotating the screw 78 in response to activation of the motor 62.

Figure 9:
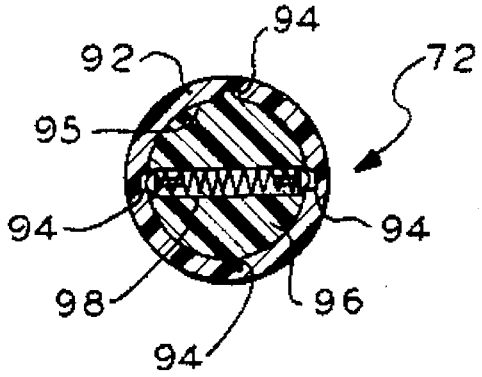
FIG. 9 is a plan sectional view of the clutch portion of the screw drive mechanism of FIG. 7 taken along lines 9—9.
Figure 10:
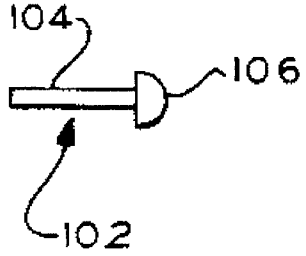
FIG. 10 is a side elevation view of a portion of the clutch of FIG. 9.
Figure 11:
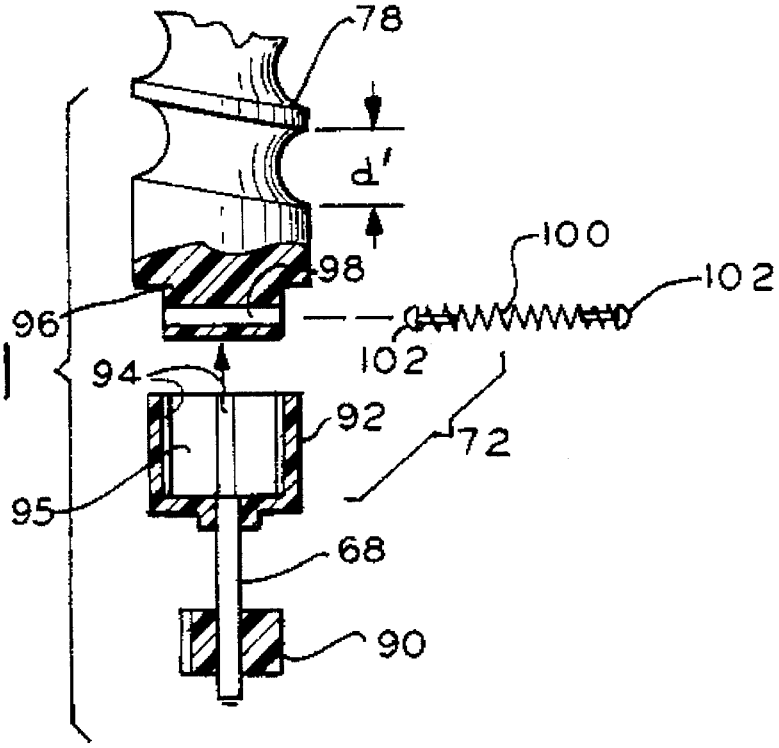
FIG. 11 is an exploded side elevation view of the clutch portion of the screw drive mechanism.

In FIGS. 9, 10 and 11, the clutch 72 comprises a molded cup-like housing formed with four axially extending grooves 94 in cavity 95. The screw 78 is formed with an axially extending cylindrical member 96 which closely rotatably fits within the cavity 95. A transverse through bore 98 is in member 96.

A spring 100 and two like male clutch members 102 each have a stem 104 that fits within the core of the spring 100. The members 102 have a semi-spherical head 106 that protrudes from the spring to form a detent mechanism with the engaged grooves 94.

In operation of the clutch, the heads 106 when resiliently engaged with the grooves 94 couple the screw 78 to shaft 68 so that operation of the motor 62 rotatably drives the screw 78. However, manual rotation of the screw via the knob 82, FIG. 7, causes the heads 104 of clutch members 102 to resiliently disengage the grooves 94, decoupling the screw 78 from the motor 62 and the drive gears.

In FIG. 7, a battery 108 terminal is electrically coupled to the motor 62 via a contact 110 in battery cover 112 connected to one terminal of the motor 62. A second contact 114 connects the battery other terminal to one terminal of a push button switch 116 which is resiliently held open by a spring 118, FIG. 8. A second terminal of the switch 116 is connected to a second motor 62 terminal.

In operation of the dispenser 2, cover 24 is rotated to the position shown in phantom, FIG. 1, and the compartment 14 filled with candy pieces 18, which are multi-colored and visible through the housing walls providing a pleasing visual effect. The label 28 covers the mechanism of FIG. 7 in the lower compartment 16 enhancing the pleasing visual effect. A further enhancement is the screw 78 which is molded of thermoplastic material of a color the same as the covers 24 and 112.

The housing is hand held in the upright orientation of FIG. 1 relative to the force of gravity so that the candy pieces are forced by gravity onto ramps 30, 30'. The ribs 74, FIG. 4, position a bottom layer of candy pieces 18 on the ramp 30" in channel 76 in single serial file toward the screw 78. The ribs 42 and 42' isolate and preclude the stored candy pieces in the screw 78 groove 80 along the length of the screw from being carried by the screw to the dispensing port 12.

This isolation is because as shown in FIG. 7, the pieces 18 protrude beyond the screw groove 88, the pieces being oriented only as shown in the groove 88. The pieces abut the ribs 42 and 42' when rotated about the screw and are forced to remain in the storage portion of the compartment 14.

The ribs 42 and 42' are closely spaced to the screw 78 preventing the pieces from entering the channel 52. Therefore all pieces that enter the groove 88 along the length of ribs 42 and 42' are retained in the main storage region of compartment 14 and do not jam the screw. The screw being in contact with the pieces in the storage compartment moves the pieces about lifting them from the entrance to the channel 34 preventing jams at this entrance. Only those pieces serially aligned at the base of the screw 78 on ramp portion 30", FIG. 5, are permitted to enter into channel 34 via the screw groove 80. Even without the ribs 74, the pieces would enter the channel 34 serially.

The pieces in channel 76 are displaced into the groove 88 when the screw is rotated. Closing the circuit to the motor 62 via push button 116 operates the motor which via the clutch 72 rotates the screw. The button 116 is conveniently depressed by the thumb when the dispenser is hand held. This rotation displaces the pieces 18 into the channel 34 and thence into channel 52. These pieces are all in a single file. There is at most one piece in each axial position of groove 88 facing channel 52, FIG. 7. As the screw is rotated the helix of the groove 88 displaces the pieces linearly lifting them toward port 12 in channel 52. When the pieces reach port 12 they exit the dispenser 2, preferably into the users other hand.

Should the battery be inoperative or for other reasons, the knob 82 on the top of the screw 78 can used to manually rotate the screw in either direction. The drive train to the motor 62 from the screw 78 offers resistance to such manual rotation. Therefore, the clutch 72 decouples the gears and motor from the screw so that the screw is easily rotated manually. This rotation causes the heads 106 of the clutch members 102 to resiliently disengage the clutch grooves 94. When the heads 106 engage the grooves 94, the motor 62 is once again coupled to drive the screw 78. Only that portion of the screw above the clutch in compartment 14 is visible externally. This permits the user to observe the screw feeding the candy pieces to the port.

It will occur to those of ordinary skill that various modifications may be made to the disclosed embodiment. It is intended that the scope of the invention be according to the appended claims, and not be limited to the disclosed embodiment.

What is claimed is:

1. A toy candy dispenser comprising:

a housing having a storage compartment for storing a plurality of candy pieces to be dispensed;

a dispensing port;

means arranged so that the pieces in the compartment are isolated from the port; and manually and electrically operated displacement means for selectively manually and electrically displacing the pieces from the compartment to the port.

2. The dispenser of claim 1 wherein the displacement means includes channel means for displacing the pieces from the compartment to the port one piece at a time.

3. The dispenser of claim 2 wherein the displacement means includes a rotatable piece displacement screw having a length in the compartment, the compartment having a bottom ramp wall for feeding the stored pieces to a screw entrance region by the force of gravity when the compartment is vertically above the ramp wall, a first channel in the housing in communication with the port and screw and with the compartment adjacent the bottom wall forming said screw entrance region, said first channel extending along said screw, said screw displacing said fed pieces from the entrance region to the port along the channel.

4. The dispenser of claim 3 wherein the screw is in communication along its length with the storage compartment such that the stored pieces engaged with the screw along the length of the screw in the storage compartment are lifted away from said entrance to preclude jams of said stored pieces at said entrance.

5. The dispenser of claim 2 wherein the displacement means includes clutch means for selectively manually and electrically operating the screw means.

6. The dispenser of claim 3 wherein the pieces, screw and first channel are dimensioned so that the pieces are displaced serially along the first channel to the port in response to rotation of the screw, said dispenser including a second channel in and at the bottom of said compartment for arranging said pieces serially and for feeding said serially arranged pieces to said entrance region in response to the force of gravity as the pieces are displaced by said screw.

7. The dispenser of claim 1 wherein the displacement means includes screw means for selectively displacing the pieces to the port.

8. The dispenser of claim 1 wherein the displacement means includes a piece displacement screw and electrically operated drive means coupled to the screw for operating the screw.

9. The dispenser of claim 8 wherein the displacement screw has a manual gripping means external the housing for manually rotating the screw, the drive means including motor means including a motor and a clutch coupling the screw to the motor such that the screw can be manually rotated independently of the motor.

10. The dispenser of claim 8 wherein the housing is substantially transparent and the screw is an opaque color visible through the housing.

11. The dispenser of claim 10 including cover means on said housing for substantially covering said drive means while permitting said screw and compartment to be visible through the housing.

12. The dispenser of claim 11 wherein the housing has two opposing contiguous end portions, the drive means including motor means located in one end portion and the compartment and screw being located in the other end portion.

13. The dispenser of claim 1 wherein the housing is dimensioned to be hand held by one hand and electrically operated by the one hand.

14. A toy candy dispenser comprising:

a housing having a compartment for storing candy pieces;

a dispensing port;

means for isolating the stored pieces from the port;

a first channel in communication with the compartment at a channel entrance and with the port at a channel exit, the first channel for aligning the pieces during displacement to the port;

said housing including means forming a second channel at the bottom of said compartment for receiving and aligning said pieces serially in said compartment in response to the force of gravity and for feeding said serially aligned pieces to said entrance; and displacement means for displacing the aligned pieces at the entrance to the first channel from the second channel to the port along the first channel.

15. The dispenser of claim 14 wherein the displacement means includes screw means in communication with the compartment, first channel and port, said screw means including a screw extending along said first channel.

16. The dispenser of claim 15 wherein the screw means includes a motor, circuit means for operating the motor, and gear means coupling the motor to the screw means, said gear means including clutch means for permitting the screw to be selectively manually and electrically operated.

17. A toy candy dispenser comprising:

a housing having a storage compartment for storing candy pieces;

a candy dispensing port;

a first channel at the base of said compartment for aligning said pieces into a serial array in response to the force of gravity on said pieces in said compartment; and rotatable screw displacement means including a rotatable screw for selectively displacing candy from the first channel to the port one piece at a time.

18. The dispenser of claim 17 wherein the rotatable screw includes a knob external said compartment for manual grasping, motor means for electrically operating the screw and clutch means coupled to the motor means for permitting selective manual rotation of the screw via said knob independently of the motor.

19. The dispenser of claim 18 wherein the housing is transparent and the screw is opaque, the screw being visible externally the housing.

20. The dispenser of claim 17 wherein the screw includes manual gripping means for manual rotation of the screw.

21. The dispenser of claim 17 including a second channel in communication with the screw and with the first channel for guiding candy pieces from the first channel to the port along the screw and second channel serially as the screw rotates.

22. The dispenser of claim 17 including means in communication with the compartment for precluding jams of said selected pieces.

23. The dispenser of claim 17 wherein said housing is dimensioned to held in one hand, said displacement means including means arranged for electrically operating the displacement means by the one hand.

24. A toy dispenser comprising:

a housing having a storage compartment for storing candy pieces to be dispensed;

a dispensing port;

means arranged so that the pieces in the compartment are isolated from the port; and manually and electrically operated displacement means for selectively displacing the pieces from the compartment to the port;

said displacement means including a piece displacement screw and electrically operated drive means including motor means coupled to the screw for operating the screw;

said housing having two opposing contiguous end portions, the motor means being located in one end portion and the compartment and screw being located in the other end portion.

25. A toy dispenser comprising:

a substantially transparent housing having a storage compartment for storing candy pieces to be dispensed;

a dispensing port;

means arranged so that the pieces in the compartment are isolated from the port;

manually and electrically operated displacement means for selectively displacing the pieces from the compartment to the port;

said displacement means including a piece displacement screw of an opaque color and electrical operated drive means including motor means coupled to the screw for operating the screw; and cover means for covering said electrically operated drive means while permitting said screw and compartment to be visible through the housing;

said housing having two opposing contiguous end portions, the motor means being located in one end portion and the compartment and screw being located in the other end portion.

26. A toy candy dispenser comprising:

a housing having a storage compartment for storing a plurality of candy pieces to be dispensed;

a dispensing port;

means arranged so that the pieces in the compartment are isolated from the port; and manually and electrically operated displacement means for selectively manually and electrically displacing the pieces from the compartment to the port;

said compartment including a channel vertically at the bottom of the compartment dimensioned to serially align and segregate the pieces in single file for feeding the aligned pieces to said displacement means.

27. The toy dispenser of claim 26 wherein the bottom of said channel is formed by an inclined ramp for feeding said pieces to the displacement means by the force of gravity.

28. A dispenser comprising:

a housing having a compartment for storing pieces;

a dispensing port;

means for isolating the stored pieces from the port;

a channel in communication with the compartment and the port, the channel for aligning the pieces during displacement to the port; and displacement means including screw means in communication with the compartment and port for displacing the aligned pieces from the compartment to the port along the channel, said displacement means including a motor, a screw, circuit means for operating the motor, and gear means coupling the motor to the screw, said gear means including clutch means for permitting the screw to be selectively manually and electrically operated.

* * * * *